US006554419B2

(12) United States Patent
Missell et al.

(10) Patent No.: US 6,554,419 B2
(45) Date of Patent: Apr. 29, 2003

(54) INK JET PRINTING METHOD

(75) Inventors: Gregory E. Missell, Penfield, NY (US); Jeanne E. Kaeding, Rochester, NY (US); Richard J. Kapusniak, Webster, NY (US); Dennis E. Smith, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 126 days.

(21) Appl. No.: 09/822,730

(22) Filed: Mar. 30, 2001

(65) Prior Publication Data

US 2002/0176966 A1 Nov. 28, 2002

(51) Int. Cl.[7] ..... B41J 2/01
(52) U.S. Cl. ..... 347/105; 428/195
(58) Field of Search ..... 428/195, 323, 428/327, 500, 105, 106

(56) References Cited

U.S. PATENT DOCUMENTS 5,989,701 A * 11/1999 Goetzen et al. ..... 428/327

FOREIGN PATENT DOCUMENTS

| | | |
|---|---|---|
| JP | 71995-137433 | 11/1993 |
| JP | 111999-8569 | 7/2000 |

* cited by examiner

*Primary Examiner*—Bruce H. Hess
*Assistant Examiner*—Michael E. Grendzynski
(74) *Attorney, Agent, or Firm*—Harold E. Cole

(57) ABSTRACT

An ink jet printing method, comprising the steps of:

A) providing an ink jet printer that is responsive to digital data signals;

B) loading the printer with an inkjet recording element comprising a support having thereon an image-receiving layer comprising porous polymeric particles in a polymeric binder, the porous polymeric particles having the formula:

$$-(A)_x-(B)_y-(C)_z-$$

wherein:

A represents units of an addition polymerizable monomer containing at least two ethylenically unsaturated groups;

B represents units of a copolymerizable, α, β-ethylenically unsaturated monomer;

C represents styrenic or acrylic repeating units containing an ionic functionality;

x is from about 27 to about 99 mole %;

y is from 0 to about 72 mole %; and z is from about 1 to about 73 mole %;

C) loading the printer with an ink jet ink composition; and

D) printing on the image-receiving layer using the ink jet ink composition in response to the digital data signals.

15 Claims, No Drawings

INK JET PRINTING METHOD

CROSS REFERENCE TO RELATED APPLICATIONS

Reference is made to commonly assigned, co-pending U.S. patent application Ser. Nos.:

09/822,731 by Kaeding et al., filed of even date herewith, entitled "Ink Jet Recording Element";

09/608,466 by Kapusniak et al., filed Jun. 30, 2000 entitled "Ink Jet Recording Element"; and 09/608,842 by Missell et al., filed Jun. 30, 2000, entitled "Ink Jet Printing Method".

FIELD OF THE INVENTION

This invention relates to an inkjet printing method. More particularly, this invention relates to an ink jet printing method using an ink jet recording element containing porous polymeric particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

Be readily wetted so there is no puddling, i.e., coalescence of adjacent ink dots, which leads to non-uniform density Exhibit no image bleeding Absorb high concentrations of ink and dry quickly to avoid elements blocking together when stacked against subsequent prints or other surfaces Exhibit no discontinuities or defects due to interactions between the support and/or layer(s), such as cracking, repellencies, comb lines and the like Not allow unabsorbed dyes to aggregate at the free surface causing dye crystallization, which results in bloom or bronzing effects in the imaged areas Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Inkjet recording elements are known that employ porous or non-porous single layer or multilayer coatings that act as suitable image-receiving layers on one or both sides of a porous or non-porous support. Recording elements that use non-porous coatings typically have good image quality but exhibit poor ink dry time. Recording elements that use porous coatings exhibit superior dry times, but typically have poorer image quality and are prone to cracking and flaking.

Japanese Kokai Hei 7[1995]-137433 relates to an ink jet recording paper containing polyester-based hollow porous resin particles containing cationic groups. However, it would be desirable to provide porous resin particles containing cationic groups which are not limited to polyester resins.

Japanese Kokai Hei 11[1999]-8569 relates to an ink jet recording sheet comprising porous organic particles which may be made cationic by adsorbing a cationic surfactant. However, there is a problem with these particles in that the cationic functionality is not part of the polymeric structure and is only adsorbed to the surface, not chemically bound, so that it could be desorbed from the particle surface during manufacture, storage or imaging.

It is an object of this invention to provide an ink jet printing method using an ink jet recording element that has a fast ink dry time. It is another object of this invention to provide an ink jet printing method using an ink jet recording element containing porous particles which have an ionic functionality which will bind ink jet inks thereto, thereby providing a porous receiver that has good water fastness. It is another object of this invention to provide an ink jet printing method using an ink jet recording element that has superior coating quality with acceptable cracking and flaking with low particle agglomeration.

SUMMARY OF THE INVENTION

These and other objects are achieved in accordance with the invention which comprises an ink jet printing method, comprising the steps of:

A) providing an ink jet printer that is responsive to digital data signals;

B) loading the printer with an inkjet recording element comprising a support having thereon an image-receiving layer comprising porous polymeric particles in a polymeric binder, the porous polymeric particles having the formula:

$$-(A)_x(B)_y(C)_z-$$

wherein:

A represents units of an addition polymerizable monomer containing at least two ethylenically unsaturated groups;

B represents units of a copolymerizable, α, β-ethylenically unsaturated monomer;

C represents styrenic or acrylic repeating units containing an ionic functionality;

x is from about 27 to about 99 mole %;

y is from 0 to about 72 mole %; and z is from about 1 to about 73 mole %;

C) loading the printer with an inkjet ink composition; and

D) printing on the image-receiving layer using the ink jet ink composition in response to the digital data signals.

By use of the invention, an ink jet printing method is obtained using an ink jet recording element which has better dry time, water fastness and coating quality (cracking and flaking) than prior art elements while providing good image quality.

DETAILED DESCRIPTION OF THE INVENTION

In a preferred embodiment of the invention, x is from about 55 to about 99 mole %; y is from 0 to about 44 mole %; and z is from about 1 to about 45 mole %.

The support used in the inkjet recording element employed in the invention may be opaque, translucent or transparent. There may be used, for example, plain papers, resin-coated papers, plastics including a polyester resin such as poly(ethylene terephthalate), poly(ethylene naphthalate) and poly(ester diacetate), a polycarbonate resin, a fluorine resin such as poly(tetra-fluoro ethylene), metal foil, various glass materials, various voided or filled opaque plastics and the like. In a preferred embodiment, the support is paper or a voided plastic material. The thickness of the support employed in the invention can be from about 12 to about 500 $\mu$m, preferably from about 75 to about 300 $\mu$m.

The porous polymeric particles which are used in the invention are in the form of porous beads, porous irregularly shaped particles, or are aggregates of emulsion particles and contain an ionic functionality.

Suitable addition polymerizable monomers which can be used as Unit A above contain at least two ethylenically unsaturated groups, and may include, for example, the following monomers and their mixtures: esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate; dienes such as butadiene and isoprene; esters of saturated glycols or diols with unsaturated monocarboxylic acids, such as, ethylene glycol diacrylate, ethylene glycol dimethacrylate, triethylene glycol dimethacrylate, 1,4-butanediol dimethacrylate, 1,3-butanediol dimethacrylate, pentaerythritol tetraacrylate, trimethylol propane trimethacrylate and polyfunctional aromatic compounds such as divinylbenzene divinylnaphthalene or derivatives thereof or other divinyl compound such as divinyl sulfide or divinyl sulfone compound, and the like. Preferably, A includes ethylene glycol dimethacrylate, ethylene glycol diacrylate, 1,4-butanediol dimethylacrylate or divinylbenzene. Most preferably, A is divinylbenzene or ethylene glycol dimethacrylate.

Suitable copolymerizable, α, β-ethylenically unsaturated monomers which can be used as Unit B above include, for example, the following monomers and their mixtures: acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate; the hydroxyalkyl esters of the same acids, such as, 2-hydroxyethyl acrylate, 2-hydroxyethyl methacrylate, and 2-hydroxypropyl methacrylate; the nitriles and amides of the same acids, such as, acrylonitrile, methacrylonitrile, acrylamide, t-butylacrylamide and methacrylamide; vinyl compounds, such as, vinyl acetate, vinyl propionate, vinylidene chloride, vinyl chloride, and vinyl aromatic compounds such as styrene, t-butyl styrene, ethylvinylbenzene, chloromethylstyrene, vinyl toluene, styrene sulfonylchloride, vinylpyridine, and vinylimidazole; dialkyl esters, such as, dialkyl maleates, dialkyl itaconates, dialkyl methylene-malonates and the like. Preferably, B is styrene, vinyl toluene, ethylvinylbenzene, 2-hydroxyethyl methacrylate, chloromethylstyrene, methacrylic acid or methyl methacrylate.

The styrenic or acrylic repeating units of C above contain an ionic functionality which may be obtained using a preformed ionic monomer which carries a substantially permanent charge which survives the polymerization. Alternatively, functionalities in a formed porous polymeric particle can be modified to make them ionic. For example, pyridine can be protonated with an acid to form a quaternary nitrogen, an amine group can be quaternized with a chloroalkane, a carboxylic acid group can be neutralized with an amine or an alkali metal hydroxide to form a carboxylic anion, a chloromethyl group can be reacted with an amine to form a quaternary ammonium group, etc. Modifying functionalities in a formed porous polymeric particle is preferred.

Suitable copolymerizable, α, β-ethylenically unsaturated monomers containing a preformed ionic functionality which can be used as Unit C include, for example, the following monomers and their mixtures: cationic ethylenically unsaturated monomers, for example, vinylbenzyltrimethylammonium chloride, vinylbenzyldimethyldodecylammonium chloride, other vinylbenzylammonium salts in which the three other ligands on the nitrogen can be any alkyl or carbocyclic group including cyclic amines such as piperidine, the counter ions of which can be halides, sulfonates, phosphates, sulfates, etc.; [2-(methacryloyloxy) ethyl]trimethyl-ammonium chloride, [2-(acryloyloxy) ethyl]-trimethylammonium p-toluene-sulfonate, and other acrylate and methacrylate ammonium salts in which the alkyl group connecting the acrylic function to the nitrogen can be ≧2 carbon atoms long and the other three nitrogen ligands can be any alkyl or carbocyclic group including cyclic amines such as piperidine, and benzyl; 4-vinyl-1-methylpyridinium methyl sulfate, 3-methyl-1-vinylimidazolium methosulfate, and other vinylpyridinium and vinylimidazolium salts in which the other nitrogen ligand is any alkyl or cycloalkyl group; vinyltriphenylphosphonium bromide, vinylbenzyltriphenylphosphonium tosylate, and other phosphonium salts in which the other three phosphorous ligands are any aromatic or alkyl group. In a preferred embodiment, the cationic functionality is vinylbenzyltrimethylammonium chloride, vinylbenzyl-N-butylimidazolium chloride, vinylbenzyldimethyldodecylammonium chloride or vinylbenzyldimethyloctadecylammonium chloride.

Other suitable copolymerizable, α, β-ethylenically unsaturated monomers containing a preformed ionic functionality which can be used as Unit C include, for example, the following monomers and their mixtures: anionic ethylenically unsaturated monomers such as 2-phosphatoethyl acrylate potassium salt, 3-phosphatopropyl methacrylate ammonium salt, and other acrylic and methacrylic esters of alkylphosphonates in which the alkyl group connecting the acrylic function to the phosphate function can be ≧2 carbon atoms long, the counter ions of which can be alkali metal cations, quaternary ammonium cations, phosphonium cations, or the like; sodium methacrylate, potassium acrylate, and other salts of carboxylic acids; styrenesulfonic acid ammonium salt, methyltriphenylphosphonium styrenesulfonate, and other styrene sulfonic acid salts; 2-sulfoethyl methacrylate pyridinium salt, 3-sulfopropyl acrylate lithium salt, and other acrylic and methacrylic esters of alkylsulfonates; and other sulfonates such as ethylene sulfonic acid sodium salt. In a preferred embodiment, the anionic functionality is trimethylammonium salt of methacrylic acid, dimethylbenzylammonium salt of methacrylic acid, dimethyldodecylammonium salt of methacrylic acid or methyltrioctylammonium salt of styrenesulfonic acid.

If the repeating Unit C is to be formed after the porous polymeric particle is prepared, all or some of Units A or Units B in a porous polymeric particle can be modified to make them (or part of them) ionic. All of the cationic and anionic functionalities mentioned above can be incorporated by modifying a non-ionic porous polymeric particle.

The porous polymeric particles used in this invention can be prepared, for example, by pulverizing and classification of porous organic compounds, by emulsion, suspension, and dispersion polymerization of organic monomers, by spray drying of a solution containing organic compounds, or by a polymer suspension technique which consists of dissolving an organic material in a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbooks as G. Odian in "Principles of Polymerization", 2nd Ed. Wiley (1981), and W. P. Sorenson and T. W. Campbell in "Preparation Method of Polymer Chemistry", 2nd Ed, Wiley (1968).

Techniques to synthesize porous polymer particles are taught, for example, in U.S. Pat. Nos. 5,840,293; 5,993,805; 5,403,870; and 5,599,889, and Japanese Kokai Hei 5[1993]-222108, the disclosures of which are hereby incorporated by reference. For example, an inert fluid or porogen may be mixed with the monomers used in making the porous polymer particles. After polymerization is complete, the resulting polymeric particles are, at this point, substantially porous because the polymer has formed around the porogen thereby forming the pore network. This technique is described more fully in U.S. Pat. No. 5,840,293 referred to above.

A preferred method of preparing the porous polymeric particles used in this invention includes forming a suspension or dispersion of ethylenically unsaturated monomer droplets containing the crosslinking monomer A, the monomer containing an ionic functionality or a monomer containing a group which will be converted to an ionic functionality, and a porogen in an aqueous medium, polymerizing the monomer to form porous polymeric particles, and optionally removing the porogen by vacuum stripping. In a preferred embodiment of the invention, the particles thus prepared have a porosity as measured by a specific surface area of greater than 100 $m^2/g$. The surface area is usually measured by B.E.T. nitrogen analysis known to those skilled in the art.

The porous polymeric particles used in the invention may be covered with a layer of colloidal inorganic particles as described in U.S. Pat. Nos. 5,288,598; 5,378,577; 5,563,226 and 5,750,378, the disclosures of which are incorporated herein by reference. The porous polymeric particles may also be covered with a layer of colloidal polymer latex particles as described in U.S. Pat. No. 5,279,934, the disclosure of which is incorporated herein by reference.

The porous polymeric particles used in this invention generally have a median diameter of from about 0.05 $\mu$m to about 10 $\mu$m, preferably from about 0.1 $\mu$m to about 5 $\mu$m. Median diameter is defmed as the statistical average of the measured particle size distribution on a volume basis. For further details concerning median diameter measurement, see T. Allen, "Particle Size Measurement", 4th Ed., Chapman and Hall, (1990).

As noted above, the polymeric particles used in the invention are porous. By porous is meant particles which either have voids or are permeable to liquids. Preferred are particles which have voids. These particles can have either a smooth or a rough surface.

The polymeric binder used in the invention may comprise a poly(vinyl alcohol), a gelatin, a cellulose ether, polyvinylpyrrolidone, poly(ethylene oxide), etc. In a preferred embodiment of the invention, the ratio of the particles to the binder is from about 2:1 to about 15:1.

The image-receiving layer may also contain additives such as pH-modifiers like nitric acid, cross-linkers, rheology modifiers, surfactants, UV-absorbers, biocides, lubricants, water-dispersible latexes, mordants, dyes, optical brighteners etc.

The image-receiving layer may be applied to one or both substrate surfaces through conventional pre-metered or post-metered coating methods such as blade, air knife, rod, roll, slot die, curtain, slide, etc. The choice of coating process would be determined from the economics of the operation and in turn, would determine the formulation specifications such as coating solids, coating viscosity, and coating speed.

The image-receiving layer thickness may range from about 5 to about 100 $\mu$m, preferably from about 10 to about 50 $\mu$m. The coating thickness required is determined through the need for the coating to act as a sump for absorption of ink solvent.

Ink jet inks used to image the recording elements used in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Preparation C1—Synthesis of Control Polymeric Particles (No Ionic Functionality)

To a beaker were added the following ingredients: 53 g methacrylic acid and 208 g ethylene glycol dimethacrylate as a monomer mixture, 132 g toluene as a porogen, 8 g hexadecane, and 3.9 g 2,2'-azobis(2,4-dimethylvaleronitrile), Vazo 52® (DuPont Corp.). The ingredients were stirred until all the solids were dissolved.

To this solution was added a mixture of 1.6 g alkyl ($C_{14}$ 50%, $C_{16}$ 10%, $C_{12}$ 40% ) dimethyl benzyl ammonium chloride, Barquat MB-50® (Lonza Inc.) in 1200 g water, which had been adjusted to pH=2.5 with 10% hydrochloric acid. The mixture was then stirred with a marine prop type agitator for 5 minutes to form a crude emulsion. The crude emulsion was passed through a Gaulin® colloid mill set at 3600 rev./min., 0.25 mm gap, and 3.8 kg/minute throughput. The resulting monomer droplet dispersion was placed into a 2-liter three-necked round bottom flask. The flask was placed in a 50° C. constant temperature bath and the dispersion stirred at 130 rev./min. under positive pressure nitrogen for 16 hours to polymerize the monomer droplets into porous polymeric particles. The product was filtered through a coarse filter to remove coagulum. Next, 0.6 g MAZU® antifoam agent (BASF Corp.) was added and toluene and some water were distilled off under vacuum at 60° C. to give 28.9% solids. The porous polymeric particles were measured by a particle size analyzer, Horiba LA-920®, and found to be 1.5 $\mu$m in median diameter. The pH was measured and found to be 3.3. A dried portion of the dispersion, analyzed by B.E.T. Multipoint using a Quantachrome Corp., NOVA® analyzer had a specific surface area of 21 $m^2/g$.

Preparation 1—Porous Polymeric Particles Containing Ionic Functionality (Invention)

The dispersion described in Preparation C1 above was modified by reacting it with trimethylamine to form an ionic functionality. The pH was measured and found to be 6.9. The dispersion was determined to be 28.9% solids. The porous polymeric particles were measured by a particle size analyzer, Horiba LA-920®, and found to be 1.5 $\mu$m in median diameter.

Preparation 2—Porous Polymeric Particles Containing Ionic Functionality (Invention)

The dispersion described in Preparation C1 above was modified by reacting it with N, N-dimethyl-N-benzylamine to form an ionic functionality. The pH was measured and found to be 6.4. The dispersion was determined to be 29.7% solids. The porous polymeric particles were measured by a particle size analyzer, Horiba LA-920®, and found to be 1.5 $\mu$m in median diameter.

Preparation C2—Synthesis of Control Polymeric Particles (No ionic functionality)

To a beaker were added the following ingredients: 321.6 g divinylbenzene, DVB-HP® (Dow Chemical Corp.) and 80.4 g methacrylic acid as a monomer mixture, 774 g toluene as a porogen, 24 g hexadecane, and 6.0 g 2,2'-azobis (2,4-dimethylvaleronitrile), Vazo 52®. The ingredients were stirred until all the solids were dissolved.

To this solution was added a mixture of 22.5 g sodium acetate trihydrate, 45.0 g acetic acid, 51.9 g of a low molecular weight copolymer of methylaminoethanol and adipic acid, and 624 g 50% colloidal silica, Ludox TM® (DuPont Corp.) in 2070 g water. The mixture was then stirred with a marine prop type agitator for 5 minutes to form a crude emulsion. The crude emulsion was passed through a Gaulin® homogenizer at 240 $kg/cm^2$. The resulting monomer droplet dispersion was placed into a 5-liter three-necked round bottom flask. The flask was placed in a 50° constant temperature bath and the dispersion stirred at 125 rev./min. under positive pressure nitrogen for 16 hours to polymerize the monomer droplets into porous polymeric particles. The product was filtered through a coarse filter to remove coagulum. Next, toluene and some water were distilled off under vacuum at 60° to give 24.6% solids. The porous polymeric particles were measured by a particle size analyzer, Horiba LA-920®, and found to be 1.3 $\mu$m in median diameter. The pH was measured and found to be 4.3. A dried portion of the dispersion, analyzed by B.E.T. Multipoint using a Quantachrome Corp. NOVA® analyzer had a specific surface area of 221.98 $m^2/g$.

Preparation 3—Porous Polymeric Particles Containing Ionic Functionality (Invention)

The dispersion described in Preparation C2 above was modified by reacting it with 70.9 g N, N-dimethyl-N-dodecylamine to form an ionic functionality. The pH was measured and found to be 6.1. The dispersion was determined to be 26.4% solids. The porous polymeric particles were measured by a particle size analyzer, Horiba LA-920®, and found to be 1.7 $\mu$m in median diameter. A dried portion of the dispersion, analyzed by B.E.T. Multipoint using a Quantachrome Corp. NOVA® had a specific surface area of 137 $m^2/g$.

Preparation C3 —Synthesis of Control Polymeric Particles (No Ionic Functionality)

To a beaker were added the following ingredients: 134 g divinylbenzene, DVB-HP® as a monomer, 258 g toluene as a porogen, 8 g hexadecane, and 2.0 g 2,2'-azobis(2,4-dimethylvaleronitrile), Vazo 52®. The ingredients were stirred until all the solids were dissolved.

To this solution was added a mixture of 7.5 g sodium acetate trihydrate, 15.0 g acetic acid, 17.3 g of a low molecular weight copolymer of methylaminoethanol and adipic acid, and 208 g 50% silica, Ludox TM® in 690 g water. The mixture was then stirred with a marine prop type agitator for 5 minutes to form a crude emulsion. The crude emulsion was passed through a Gaulin® homogenizer at 225 $kg/cm^2$. The resulting monomer droplet dispersion was placed into a 2-liter three-necked round bottom flask. The flask was placed in a 50° constant temperature bath and the dispersion stirred at 150 rev./min. under positive pressure nitrogen for 16 hours to polymerize the monomer droplets into porous polymeric particles. Toluene and some water were distilled off under vacuum at 60°. The product was filtered through a coarse filter to remove coagulum to give a product of 23.4% solids. The porous polymeric particles were measured by a particle size analyzer, Horiba LA-920®, and found to be 1.0 $\mu$m in median diameter.

Preparation 4—Porous Polymeric Particles Containing Ionic Functionality (Invention)

To a beaker were added the following ingredients: 107.2 g divinylbenzene, DVB-HP® and 26.8 g chloromethylstyrene as a monomer mixture, 258 g toluene as a porogen, 8 g hexadecane, and 2.0 g 2,2'-azobis(2,4-dimethylvaleronitrile), Vazo 52®. The ingredients were stirred until all the solids were dissolved.

To this solution was added a mixture of 7.5 g sodium acetate trihydrate, 15.0 g acetic acid, 17.3 g of a low molecular weight copolymer of methylaminoethanol and adipic acid, and 208 g 50% silica, Ludox TM® in 690 g water. The mixture was then stirred with a marine prop type agitator for 5 minutes to form a crude emulsion. The crude emulsion was passed through a Gaulin® homogenizer at 225 $kg/cm^2$. The resulting monomer droplet dispersion was placed into a 2-liter three-necked round bottom flask. The flask was placed in a 50° C. constant temperature bath and the dispersion stirred at 150 rev./min. under positive pressure nitrogen for 16 hours to polymerize the monomer droplets into porous polymeric particles. Toluene and some water were distilled off under vacuum at 60° C. The product was filtered through a coarse filter to remove coagulum to give a product of 22.7% solids. The porous polymeric particles were measured by a particle size analyzer, Horiba LA-920®, and found to be 1.0 $\mu$m in median diameter.

Three 345 g aliquots of the above dispersion were put into three one-liter three-necked round bottomed flasks, each equipped with a paddle stirrer and condenser. Two of the aliquots were set aside for use in Preparations 5 and 6. Into the third aliquot was placed 50 mL of a 25 wt % solution of trimethylamine in water, and 250 g distilled water. The dispersion was stirred and heated overnight at 60° C. Unreacted trimethylamine was distilled off under vacuum at 60° C., and the pH was measured to be 7.5. The product was filtered through a coarse filter to remove coagulum. The final product was 12.4% solids. The porous polymeric particles were measured by a particle size analyzer, Horiba LA-920®, and found to be 1.2 μm in median diameter. A dried portion of the dispersion, analyzed by B.E.T. Multipoint using a Quantachrome Corp. NOVA® analyzer had a specific surface area of 165 $m^2/g$.

Preparation 5—Porous Polymeric Particles Containing Ionic Functionality (Invention)

Into one of the remaining three-necked round bottomed flasks containing 345 g of the dispersion from Preparation 4 was placed 11.2 g of N-butylimidazole and 300 g distilled water. The dispersion was stirred and heated overnight at 60° C. The product was filtered through a coarse filter to remove coagulum. The final product was 13.5% solids, pH=6.5. The porous polymeric particles were measured by a particle size analyzer, Horiba LA-920®, and found to be 1.2 μm in median diameter.

Preparation 6—Porous Polymeric Particles Containing Ionic Functionality (Invention)

Into the remaining three-necked round bottomed flask containing 345 g of the dispersion from Preparation 4 was placed 19.2 g of dimethyldodecylamine and 250 g distilled water. The dispersion was stirred and heated overnight at 60° C. The product was filtered through a coarse filter to remove coagulum. The final product was 12.4% solids, pH=6.5. The porous polymeric particles were measured by a particle size analyzer, Horiba LA-920®, and found to be 1.5 μm in median diameter.

Preparation 7—Porous Polymeric Particles Containing Ionic Functionality (Invention)

To a beaker were added the following ingredients: 107.2 g ethylene glycol dimethacrylate and 26.8 g N-vinylbenzyl-N,N-dimethyl-N-octadecylammonium chloride as a monomer mixture, 62 g propyl acetate as a porogen, 4 g hexadecane, and 2.25 g 2,2'-azobis(2,4-dimethylvaleronitrile), Vazo 52®. The ingredients were stirred until all the solids were dissolved.

To this solution was added a mixture of 0.8 g Barquat MB-50® in 600 g water. The mixture was then stirred with a marine prop type agitator for 5 minutes to form a crude emulsion. The crude emulsion was passed through a Gaulin® colloid mill set at 3650 rev./min., 0.17 mm gap, and 3.8 kg/min throughput. The resulting monomer droplet dispersion was placed into a 2-liter three-necked round bottom flask. The flask was placed in a 50° C. constant temperature bath and the dispersion stirred at 140 rev./min. under positive pressure nitrogen for 16 hours to polymerize the monomer droplets into porous polymeric particles. Propyl acetate and some water were distilled off under vacuum at 60° C. The product was filtered through a coarse filter to remove coagulum. The final product was 15.2% solids. The porous polymeric particles were measured by a particle size analyzer, Horiba LA-920®, and found to be 0.74 μm in median diameter.

Preparation 8—Porous Polymeric Particles Containing Ionic Functionality (Invention)

To a beaker were added the following ingredients: 234 g ethylene glycol dimethacrylate and 26 g methyltrioctylammonium styrenesulfonate as a monomer mixture, 132 g toluene as a porogen, 8 g hexadecane, and 3.9 g 2,2'-azobis (2,4-dimethylvaleronitrile), Vazo 52®. The ingredients were stirred until all the solids were dissolved.

To this solution was added a mixture of 24 g sodium dodecylbenzene sulfonate and 1200 g water. The mixture was then stirred with a marine prop type agitator for 5 minutes to form a crude emulsion. The crude emulsion was passed through a Crepaco® homogenizer at 420 $kg/cm^2$. The resulting monomer droplet dispersion was placed into a 2-liter three-necked round bottom flask. The flask was placed in a 50° C. constant temperature bath and the dispersion stirred at 130 rev./min. under positive pressure nitrogen for 16 hours to polymerize the monomer droplets into porous polymeric particles. Toluene and some water were distilled off under vacuum at 60° C. The product was filtered through a coarse filter to remove coagulum. The final product was 13.5% solids. The porous polymeric particles were measured by a particle size analyzer, Horiba LA-920®, and found to be 0.17 μm in median diameter.

Coating of Elements

Control Element C-1

A coating solution was prepared by mixing together the control porous polymeric particles of Preparation C1 with a binder of poly(vinyl alcohol) using Gohsenol GH 23® (Gohsen Nippon of Japan). The resulting coating solution was 15% solids and 85% water, with the solids being 85% porous polymeric particles and 15% poly(vinyl alcohol). The solution was stirred at 40° C. for approximately 30 minutes before coating.

The solution was then coated on corona discharge-treated, photographic grade, polyethylene-coated paper using a wound wire metering rod, to a wet lay down of 120 μm, and oven dried for 30 minutes at 60° C. This element was coated to a dry thickness of about 18 μm.

Control Element C-2

This element was prepared the same as Control Element C-1 except that the coating solution was made using Preparation C2

Control Element C-3

This element was prepared the same as Control Element C-1 except that the coating solution was made using Preparation C3.

Elements 1-8 (Invention)

These elements were prepared the same as Control Element C-1 except that the coating solutions were made using Preparations 1-8, respectively.

Coating Quality Evaluation

Coating quality is a visual inspection of the above coated elements, looking at coating defects such as cracking, particle agglomeration, coating flaking off, coating uniformity or smoothness. The following evaluations in Table 1 were used and the results listed below in Table 3:

TABLE 1

| Rating | Coating Defects |
|---|---|
| 1 | No cracks, no flakes, uniform coating |
| 2 | Very slight cracks, very slight particle agglomeration |
| 3 | Some cracks, no flaking, some particle agglomeration |
| 4 | Severe cracking, some flaking, heavy particle agglomeration |
| 5 | Major cracking, coating flaking off, heavy particle agglomeration |

Ratings 1 and 2 are acceptable while ratings 3 to 5 are unacceptable.

Water Fastness Evaluation

Using an Epson 870 ink jet printer patches of cyan, magenta, yellow, and black were printed at 50% ink lay down. The images were dried for 24 hours. A 2-mil drop of distilled water was placed on each patch for 60 seconds and then rubbed off with a tissue. Damage to the image and the coating was visually observed and rated according to Table 2, with the results listed below in Table 3:

TABLE 2

| Rating | Water Damage |
|---|---|
| 1 | No visual damage to image or coating |
| 2 | Slight image damage, "stained", no coating damage |
| 3 | Slight ink removal, imaged damaged, no coating damage |
| 4 | Heavy ink removal and image damage, some coating damage |
| 5 | Ink and coating removed, image removed |

Ratings 1 to 3 are acceptable and ratings 4 to 5 are unacceptable.

Evaluation of Elements

The above elements were evaluated as described above with the following results:

TABLE 3

| Element | Coating Quality | Water fastness |
|---|---|---|
| Control C-1 | 2 | 5 |
| 1 | 1 | 3 |
| 2 | 1 | 3 |
| Control C-2 | 2 | 5 |
| 3 | 1 | 2 |
| Control C-3 | 2 | 4 |
| 4 | 1 | 2 |
| 5 | 1 | 2 |
| 6 | 2 | 2 |
| 7 | 2 | 2 |
| 8 | 1 | 2 |

The above results show that Control Elements C-1 to C-3 have unacceptable water fastness, while Inventive Elements 1 to 8 employed in the process of the invention have acceptable coating quality and water fastness.

This invention has been described with particular reference to preferred embodiments thereof but it will be understood that modifications can be made within the spirit and scope of the invention.

What is claimed is:

1. An ink jet printing method, comprising the steps of:

A) providing an ink jet printer that is responsive to digital data signals;

B) loading said printer with an ink jet recording element comprising a support having thereon an image-receiving layer comprising porous polymeric particles in a polymeric binder, the porous polymeric particles having the formula:

$$\overline{(A)_x(B)_y(C)_z}$$

wherein:

A represents units of an addition polymerizable monomer containing at least two ethylenically unsaturated groups;

B represents units of a copolymerizable, α, β-ethylenically unsaturated monomer;

C represents styrenic or acrylic repeating units containing an ionic functionality;

x is from about 27 to about 99 mole %;

y is from 0 to about 72 mole %; and z is from about 1 to about 73 mole %;

C) loading said printer with an ink jet ink composition; and

D) printing on said image-receiving layer using said inkjet ink composition in response to said digital data signals.

2. The method of claim 1 wherein said ionic functionality of said styrenic or acrylic repeating unit is cationic.

3. The method of claim 2 wherein said cationic functionality is vinylbenzyltrimethylammonium chloride, vinylbenzyl-N-butylimidazolium chloride, vinylbenzyldimethyldodecylammonium chloride or vinylbenzyldimethyloctadecylammonium chloride.

4. The method of claim 1 wherein said ionic functionality of said styrenic or acrylic repeating unit is anionic.

5. The method of claim 4 wherein said anionic functionality is trimethylammonium salt of methacrylic acid, dimethylbenzylammonium salt of methacrylic acid, dimethyldodecylammonium salt of methacrylic acid or methyltrioctylammonium salt of styrenesulfonic acid.

6. The method of claim 1 wherein x is from about 55 to about 99 mole %;

y is from 0 to about 44 mole %; and z is from about 1 to about 45 mole %.

7. The method of claim 1 wherein said porous polymeric particles have a median diameter of from about 0.05 μm to about 10 μm.

8. The method of claim 1 wherein said porous polymeric particles have a median diameter of from about 0.1 μm to about 5 μm.

9. The method of claim 1 wherein said polymeric binder comprises a poly(vinyl alcohol), a gelatin, a cellulose ether, poly(vinyl pyrrolidone) or poly(ethylene oxide).

10. The method of claim 1 wherein said support is paper or a voided plastic material.

11. The method of claim 1 wherein the porosity of said porous polymeric particles is achieved by mixing a porogen with the monomers used to make said polymeric particles, dispersing the resultant mixture in water, and polymerizing said monomers to form said porous polymeric particles.

12. The method of claim 1 wherein said porous polymeric particles have a surface area of greater than 100 $m^2/g$.

13. The method of claim 1 wherein the ratio of said particles to said binder is from about 2:1 to about 15:1.

14. The method of claim 1 wherein said A is ethylene glycol dimethacrylate, ethylene glycol diacrylate, 1,4-butanediol dimethylacrylate or divinylbenzene.

15. The method of claim 1 wherein said B is styrene, vinyl toluene, ethylvinylbenzene, 2-hydroxyethyl methacrylate, chloromethylstyrene, methacrylic acid or methyl methacrylate.

* * * * *